US007219391B1

(12) United States Patent
Luca

(10) Patent No.: US 7,219,391 B1
(45) Date of Patent: May 22, 2007

(54) DOOR ASSEMBLY WITH CONCEALED DOOR CLOSER

(76) Inventor: Valentin Luca, 1157 Melville Ave., Fairfield, CT (US) 06825

( * ) Notice: Subject to any disclaimer, the term of this patent is extended or adjusted under 35 U.S.C. 154(b) by 205 days.

(21) Appl. No.: 10/807,021

(22) Filed: Mar. 23, 2004

(51) Int. Cl.
*E05F 3/02* (2006.01)
*E05F 11/00* (2006.01)

(52) U.S. Cl. ..... 16/50; 16/68; 49/348

(58) Field of Classification Search ..... 16/50, 16/54, 49, 59, 61, 68, 71, 72, 82, 85, 63, 16/DIG. 10, 70; 49/339, 380, 386, 414, 49/501, 348, 371, 372, 381, 384
See application file for complete search history.

(56) References Cited

U.S. PATENT DOCUMENTS 1,898,609 A * 2/1933 Anderson ..... 16/61
2,903,733 A * 9/1959 Schroeder ..... 16/49
3,143,757 A * 8/1964 Quinn ..... 16/57
3,707,014 A * 12/1972 Koivusalo ..... 16/52
4,429,491 A * 2/1984 Bruns ..... 49/340
5,170,530 A * 12/1992 Kopec et al. ..... 16/52
5,956,806 A * 9/1999 Tutikawa ..... 16/66
6,223,469 B1 * 5/2001 Moll ..... 49/341
6,681,525 B1 * 1/2004 Dudley ..... 49/358

OTHER PUBLICATIONS

American National Standards Institute Bulletin on Door Closer, pp. 9 to 12.

* cited by examiner

*Primary Examiner*—Robert J. Sandy
*Assistant Examiner*—Andre' L. Jackson
(74) *Attorney, Agent, or Firm*—Fattibene & Fattibene; Arthur T. Fattibene; Paul A. Fattibene

(57) ABSTRACT

A door assembly and a door closer arranged and constructed so as to be wholly concealed within the associated door, yet is rendered readily accessible to effect the adjustment thereof to regulate or control the closing speed of the associated door. The door closer is capable of performing all of the functions expected of a door closer such as controlling the closing force, regulating the door closing speed and the arresting of the door in a predetermined opened position.

5 Claims, 10 Drawing Sheets

DOOR ASSEMBLY WITH CONCEALED DOOR CLOSER

FIELD OF THE INVENTION

This invention is directed in general to door assembly, and more specifically to a door assembly with a concealed closer within the associated door.

BACKGROUND OF THE INVENTION

Door closers are commonly used on doors for effecting the closing of a door upon the release of the door on opening. Such door closers are externally connected between the door and the associated door frame. Generally, the door closers are connected to the door and associated frame about midway between the top and bottom of the door. Oftentimes, the closer is connected either adjacent the top or bottom of the door. However, wherever such door closers are externally connected between the door and the associated door frame, their presence is always quite visible and unsightly. It has also been noted that with such door closers, it often happens that one's clothing may also become entangled with the door closer. While efforts have been made to obviate the problems encountered with the conventional externally and visibly connected door closers, such known efforts entailed excessive costs and installation difficulties. Even with the currently known door closers of the so-called concealed type, a considerable portion of the operating mechanism remains readily noticeable and unsightly.

Efforts to conceal door closers included locating the closer in the floor or ceiling adjacent the door, or in the framing around the door. However, with such known floor, ceiling or frame located closers, the actuating levers or connecting mechanism associated with the floor or ceiling mounted piston and cylinder assembly of the door closer would still be visible and unsightly. Further, such floor, ceiling or door frame attempts to hide the closer assembly presented substantial installation difficulties, as is readily evident, and which installation difficulties become greatly aggravated for the after marketed installations of such closers.

SUMMARY OF THE INVENTION

An object of this invention is to provide a door assembly in which the closer which is virtually concealed within the structure of the associated door so that the closer assembly including the support elements thereof are concealed from view.

Another object of this invention is to provide a door closer assembly which can be readily concealed within any of the conventional type door structures or arrangements.

Another object is to provide a concealed door closer which is applicable for use with doors of minimum thickness, e.g. for use in storm and/or screen doors.

Another object of this invention is to provide a concealed door closer which is relatively simple in construction, positive in operation and relatively inexpensive to fabricate.

The foregoing objects, features and other advantages are achieved by a door assembly having concealed within the structure of the door a closer or linear assembly that includes a cylinder and piston unit in which the piston is linearly displaceable within the cylinder. Connected to the piston is a piston rod which extends outwardly through one end of the cylinder. The free end of the piston rod is directly or indirectly anchored to a bracket connected to the inside portion of a door frame adjacent the hinged edge of the door and centered within the thickness of the door edge to project into the hinged edge of the door. This is attained by providing a chamber disposed between the opposed side surfaces of the door in alignment with the bracket to which the linear assembly is connected. The chamber defines the housing for concealing the cylinder and piston unit or linear assembly of the door closer. The arrangement is such that the linear assembly is housed wholly within the thickness of the door so as to be completely out of sight when the door is in the closed or open position. It will be understood that one or more linear assemblies, as described, can be associated with the door depending upon the size and/or weight of the door. The linear assembly concealed within the thickness of the door is capable of performing all of the basic functions of a door closer such as, for example, applying the desired closing force to the door, controlling the closing speed and/or adjustably maintaining the door in a predetermined opened position.

IN THE DRAWINGS

DETAILED DESCRIPTION

Figure 1:
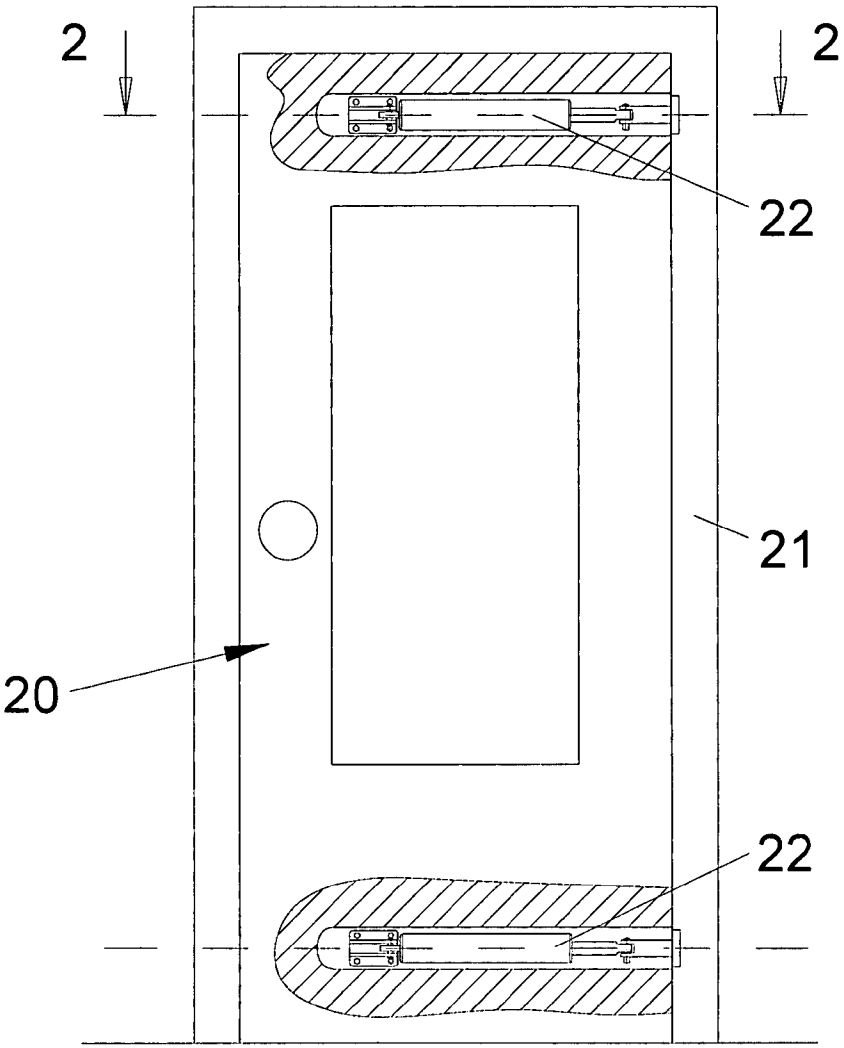
FIG. 1 is a vertical view of a door and associated door frame illustrating one form of the invention of a door closer wholly concealed within the associated door.

Referring to the drawings, there is illustrated in FIG. 1 a door 20, a door frame 21 and linear assembly 22 wholly concealed within the associated door 20. As used herein, a linear assembly is defined as a door closer or a door closing speed controlling device that includes a cylinder having a reciprocally mounted piston and a piston rod connected thereto which extends through one end of the cylinder. It will be understood that the structure of the door 20 may take any suitable form. Such doors 20 may comprise opposed longitudinal support frame 20A, 20B to which the side door panels 20C and 20D are secured to define a hollow type door. In the event of a solid door (not shown), the instant invention would require that such solid door have formed therein a chamber such as shown at 23, sized to receive the linear assembly 22. In the illustrated embodiment of FIG. 1, two such linear assemblies are illustrated, one being concealed adjacent the top of the door 20 and the other concealed adjacent the bottom of the door. The construction of the respective linear assemblies 22 is similar. However, it will be understood that depending on the size and/or weight of the door, one or more linear assemblies may be associated with any given door 20.

Figure 2:
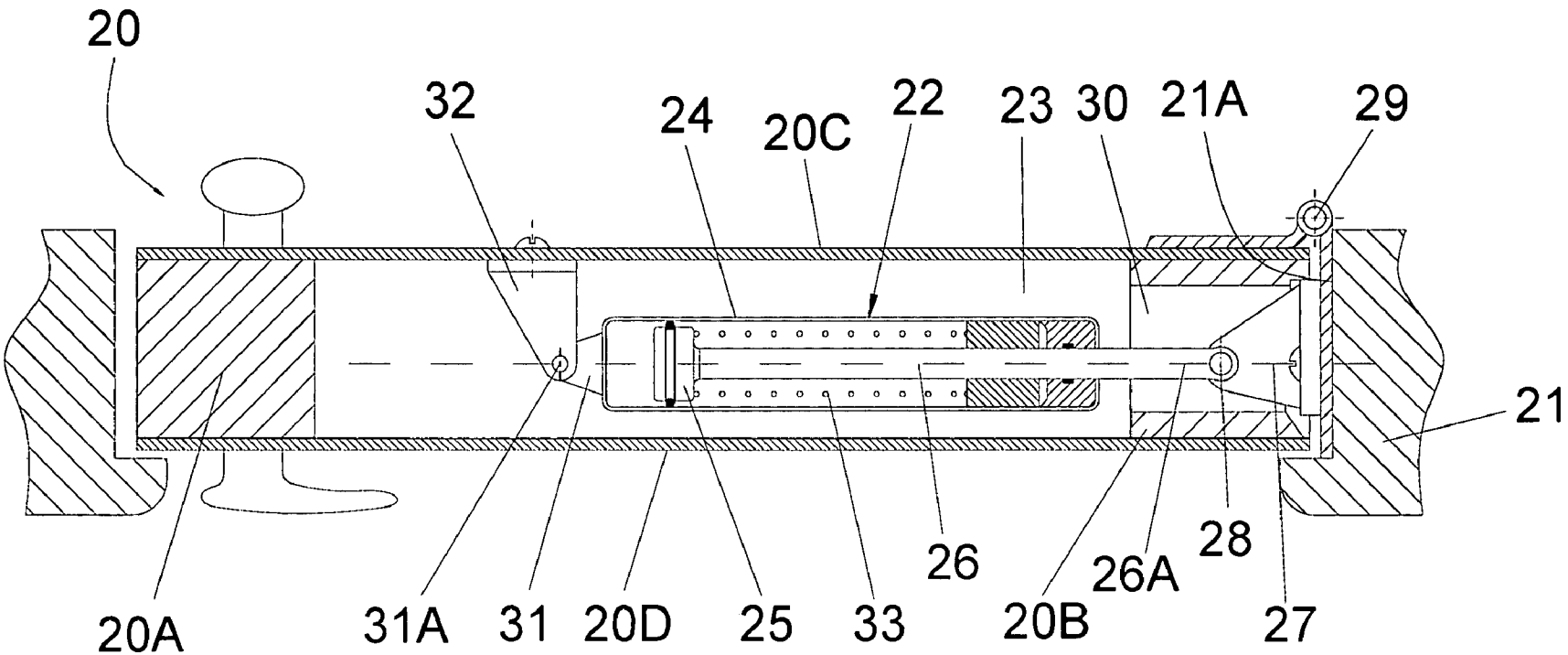
FIG. 2 is an enlarged sectional view taken along line 2—2 on FIG. 1.

In accordance with this invention, the linear assembly 22 may take several different forms. The simplest form is illustrated in FIG. 2. As shown, the linear assembly 22 includes a cylinder 24 having a piston 25 reciprocally disposed within the cylinder 24. Connected to the piston 25 is a piston rod 26 having its free end 26A pivotally connected to a support bracket 27 by means of a pivot pin 28.

The bracket 27 is connected to the inside portion or jam 21A of the door frame 21 adjacent the door hinge 29. To accommodate the support bracket 27, the support frame or edge 20B of the door 20 is drilled or formed to define a chamber or hole 30. The other end of the cylinder 24 is provided with a mounting plate 31 which is pivotally connected by a pivot 31A to an end support bracket 32, suitably secured to the inside surface of the door panel 20C.

Figure 3:
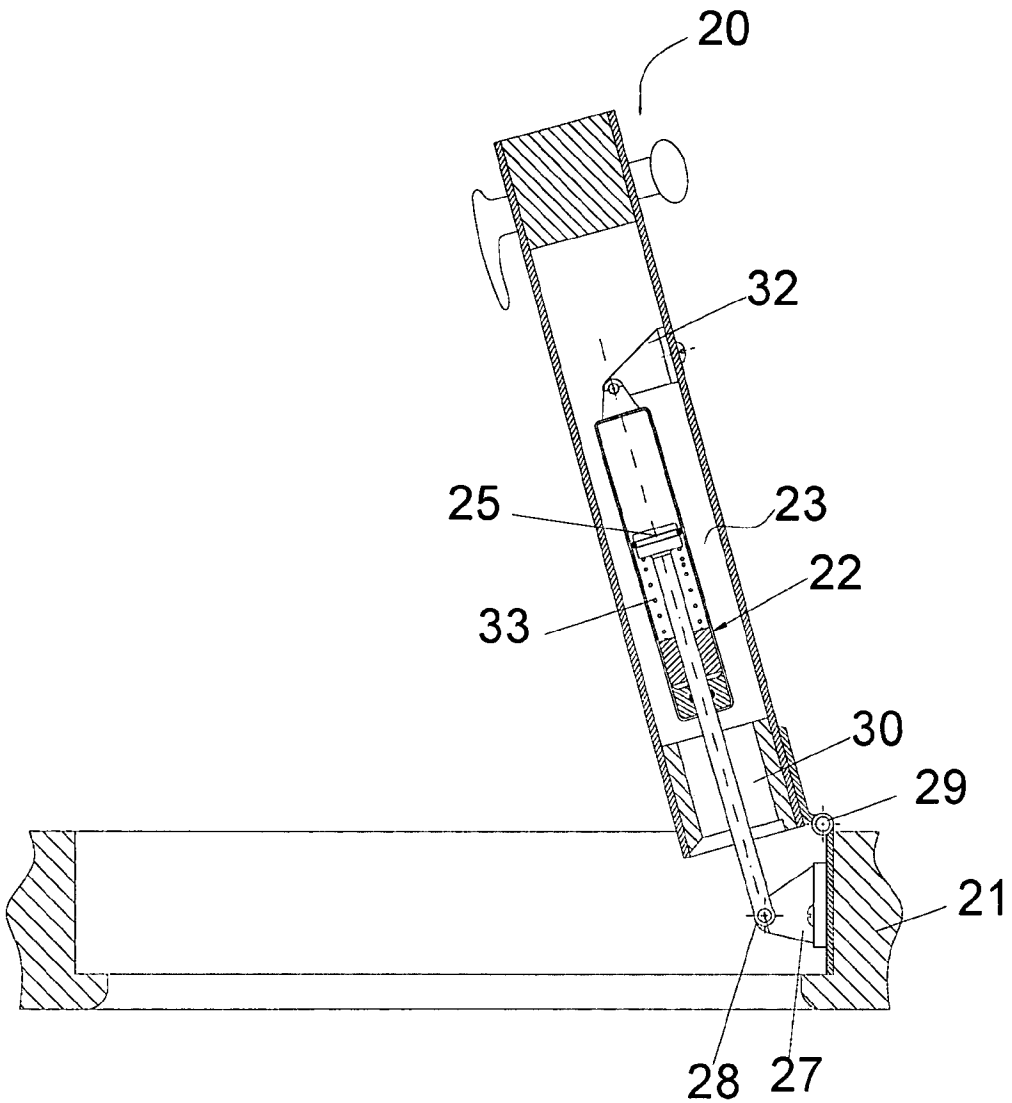
FIG. 3 is a sectional view similar to that of FIG. 2, but illustrating the door in an opened position.

In the illustrated embodiment of FIGS. 1 to 3, a compression spring 33 is interposed between the piston 25 and one end of the cylinder 24. The arrangement is such that upon the opening of the door 20, the compression spring 33 is compressed as noted in FIG. 3 so that upon the releasing of the door, the compression spring 33 will normally bias the door 20 toward its closed position as shown in FIG. 2. The cylinder may contain fluid, e.g. a liquid medium or air arranged to flow from one side of the piston 25 to the other side of the piston 25 to control the speed at which the door 20 is returned from its open position to a closed position upon release of the door. In the event air is the fluid to be controlled, a means is provided to meter the flow of air on one side of the piston to atmosphere. In the event the speed controlling fluid is a liquid, means are provided to meter the flow of liquid from one side of the piston to the other side of the piston. This can be accomplished either by an external metered circuit that bypasses the piston in directing the liquid medium from one side of the piston to the other side of the piston or providing the piston with a metered orifice through which the liquid can flow from one side of the piston to the other side thereof in a controlled manner, or the speed control can be achieved by rotating the piston rod relative to the cylinder or vice versa, or by adjusting the piston rod relative to the piston as disclosed in my co-pending patent application Ser. No. 10/446,893 filed May 28, 2003, which is incorporated by reference herein in its entirety.

In the event that the linear element 22 is used only for performing the closing force function, it is not necessary to provide any sealing between the piston and the cylinder. It will be apparent that the door closing functions, such as providing the closing force, the speed at which the door closes and/or to hold the door open or in a door arresting position, may be incorporated within the linear assembly or accomplished by different combinations of linear assemblies, which has the capability of providing one or more of the door closing functions. For example, the linear assembly for effecting a door arresting or holding position may be of the type disclosed in my co-pending patent application Ser. No. 10/627,261 filed Jul. 25, 2003, for Door Closure With Door Arresting Mechanism, which is also incorporated herein by reference in its entirety.

It will be noted that the support bracket 27 is arranged to be received within the hole 30 formed in the hinge edge of the door so that the entire linear assembly 22 and its supports 27 and 32 are wholly concealed within the door when closed.

Figure 4:
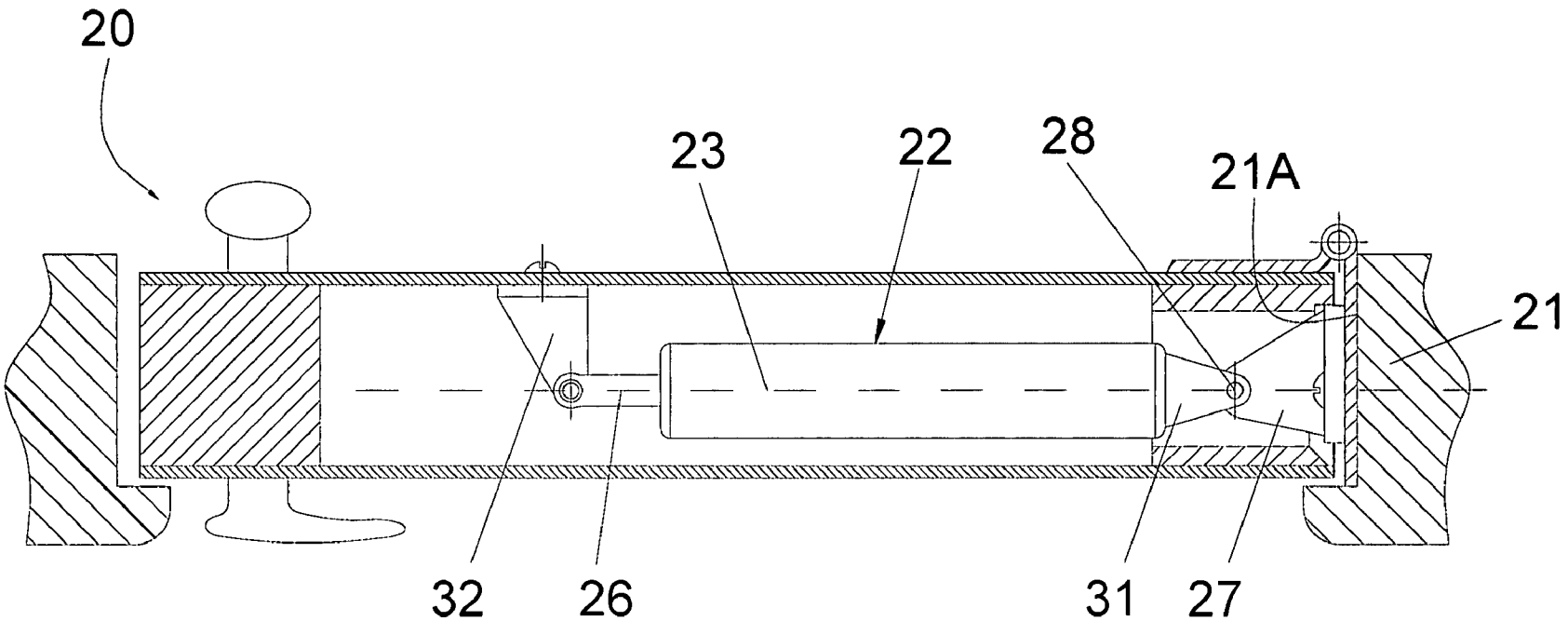
FIG. 4 is a sectional view similar to that of FIG. 2, but illustrating a slightly modified embodiment of the invention.

FIG. 4 illustrates a slightly modified form of the invention. In this form of the invention, the construction of the linear assembly 22 is similar to that hereinbefore described with respect to FIGS. 1 to 3. However, in the embodiment of FIG. 4, the linear assembly 22 is concealed within the door by pivotally connecting the mounting plate 31 of the cylinder to the support bracket 27 mounted to the door jamb 21A, and pivotally connecting the piston rod to the end support 32. In all other respects, the structure and function of the linear assembly 22 is similar to that described with respect to FIGS. 1 to 3.

Figure 5:
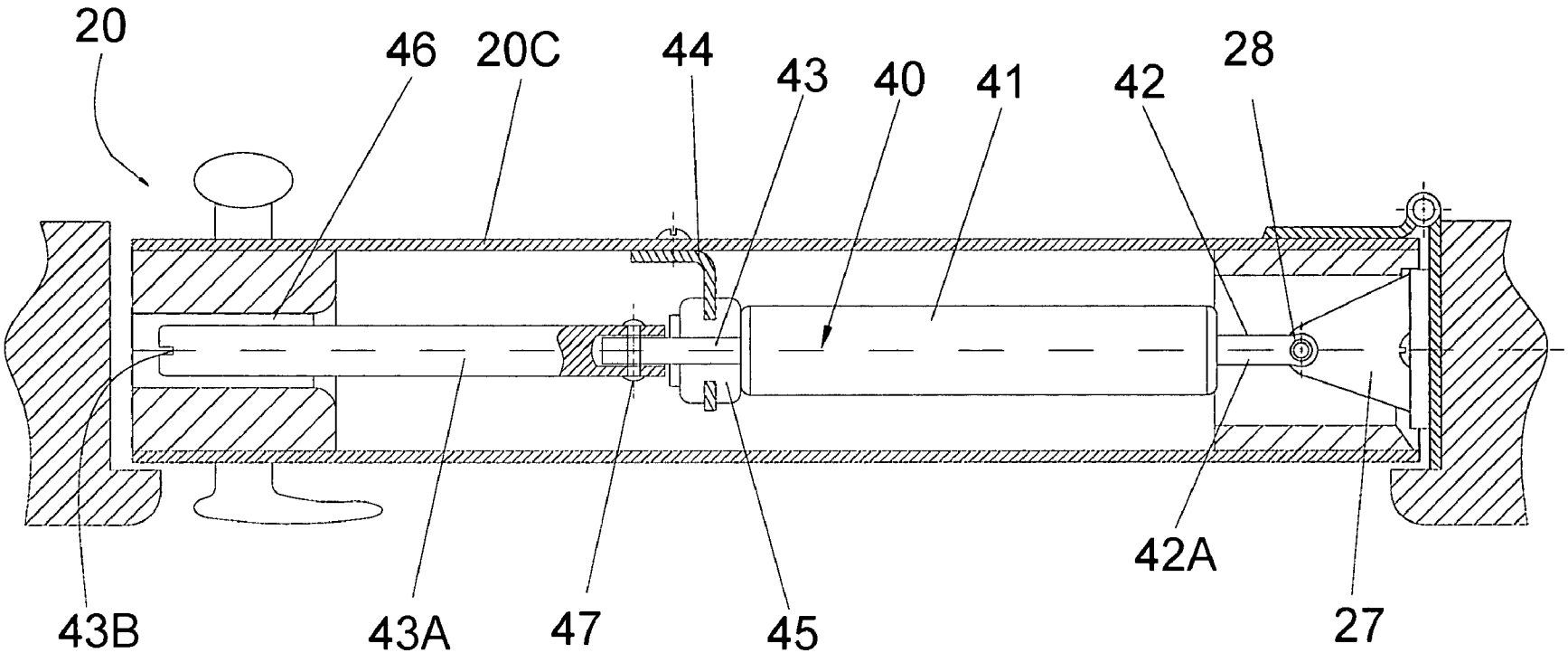
FIG. 5 is a sectional view similar to that of FIG. 2, but illustrating a modified embodiment of the invention.

FIG. 5 illustrates a modified form of the invention wherein the speed control function of the linear assembly 40 is effected by rotation of the cylinder 41 relative to the piston rod 42 and its connected piston. In this form of the invention, the free end 42A of the piston rod 42 is pivotally connected to the support bracket 27 by pivot pin 28. Connected to the other end of the cylinder 41 is a cylinder extension bar 43 supported by a mounting bracket 44 secured to door panel 20C. The mounting bracket includes a grommet or bearing 45 through which the cylinder extension 43 extends. Connected to the free end of the cylinder extension 43 is an extension rod 43A that extends to an opening 46 formed in the opposite edge of the door 20. It will be noted that the extension rod 43A is coupled to the cylinder extension 43 by any suitable means, e.g. a pin 47. Formed in the end of the extension rod 43A is a slot 43B adapted to receive a tool, e.g. a screwdriver, so as to facilitate the rotation of the cylinder 41 relative to piston rod to effect the adjustment of the speed control of the linear assembly 40. In all other respects, the operation and the structure is as hereinbefore described.

Figure 6:
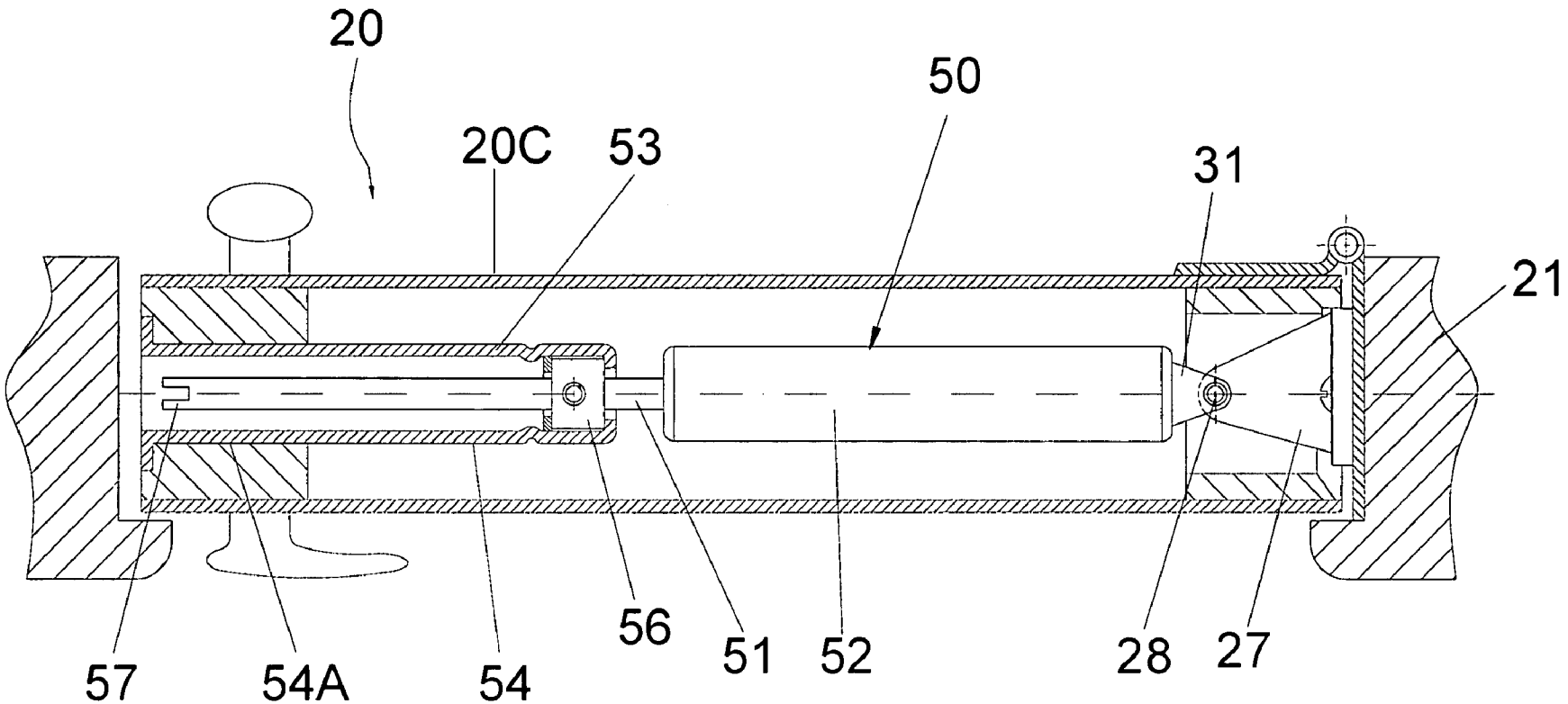
FIG. 6 is a sectional view similar to FIG. 2, but illustrating a modified embodiment of the door closer assembly.

FIG. 6 illustrates a modified embodiment of the invention wherein the speed control function of the linear assembly 50 is effected by the adjustment of a rotatable piston rod 51 relative to the stationary cylinder 52. In this form of the invention, the mounting plate 31 on the end of the cylinder 52 is pivotally connected to the support bracket 27 by a pivot pin 28. The piston rod 51 is rotatably attached to a support means 53, which is illustrated as a tube or sleeve 54, projecting inwardly of the door 20 from a hole 54A formed in the opposite edge of the door 20. At the inner end of the sleeve 54 is a bushing 56 that supports the piston rod 51 within the sleeve 54. The arrangement is such that the piston rod 51 is essentially secured against linear movement along its center line, but rotatable about its center line while allowing slight perpendicular movement relative to its support means 54. The end of the piston rod 51 is provided with a slot 57 to facilitate the rotation of the piston rod 51 by a suitable tool, e.g. a screwdriver, for effecting the adjustment of the speed control of the linear assembly 50. In all other respects, the structure and operation is similar to that hereinbefore described.

Figure 7:
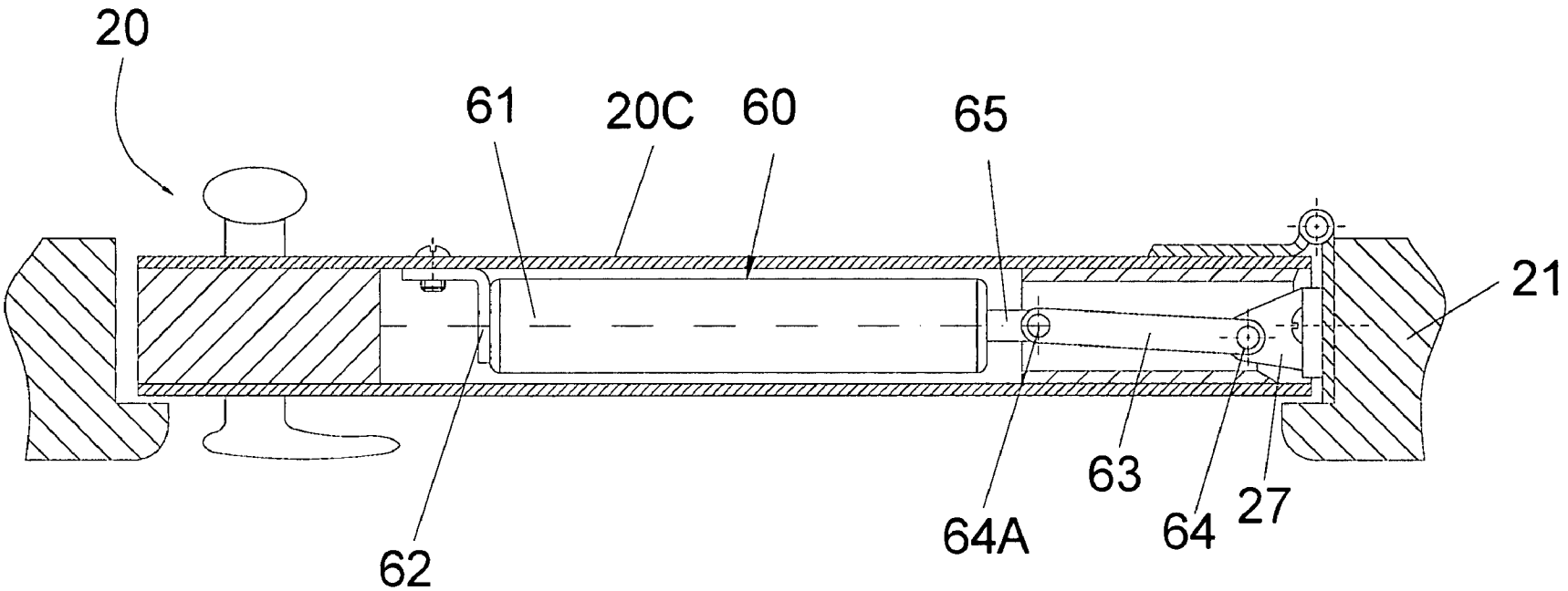
FIG. 7 is a sectional view similar to that of FIG. 2, but illustrating still another modified embodiment of the door closer assembly.

FIG. 7 illustrates a further modification of the invention. In this form of the invention, the linear assembly 60, concealed within the door 20, has one end of the cylinder 61 connected to the inner surface of the door panel 20C by means of an L-shaped bracket 62. The front or free end of the piston rod 65 is pivotally attached by pivot pin 64A to one end of a linking bar 63. The other end of the linking bar 63 is pivotally connected to the support bracket 27 by pivot pin 64. In all other respects, the structure and function is the same as hereinbefore described.

Figure 8:
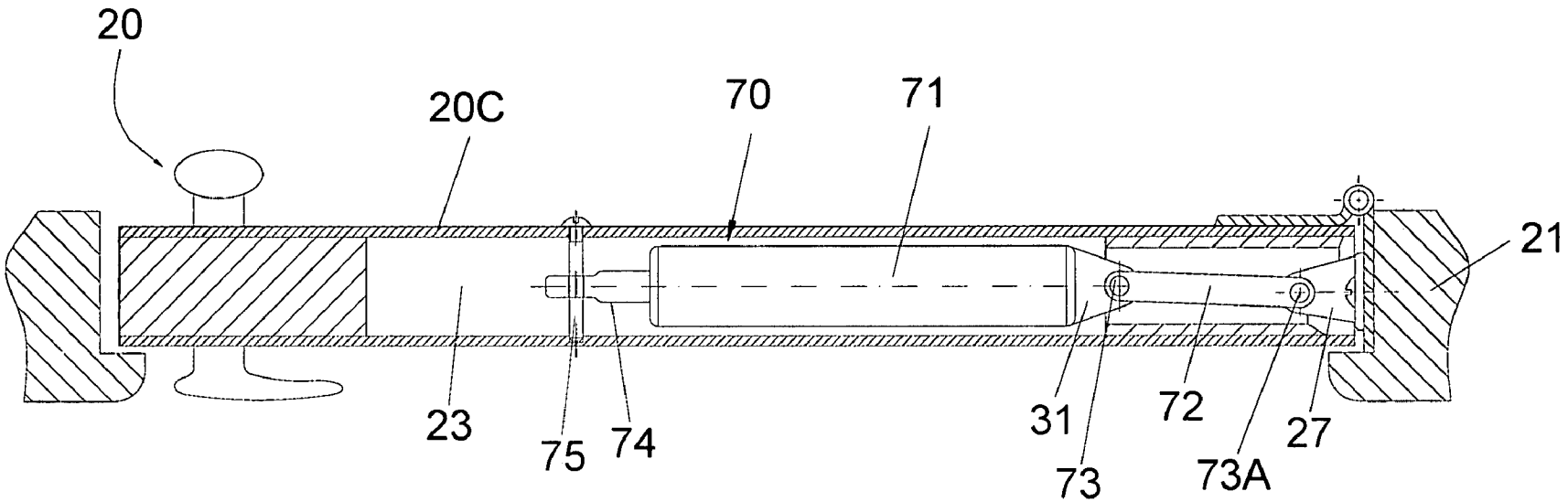
FIG. 8 is a sectional view similar to that of FIG. 2 illustrating another modified embodiment of the door closer assembly.

FIG. 8 illustrates a slightly modified form of the invention. In this form of the invention, the linear assembly 70, concealed within the door 20, has its cylinder 71 slidably disposed within the door chamber 23. This is attained by pivotally connecting the mounting plate 31 on one end of the cylinder 71 to the support bracket 27 by means of an interconnecting link 72, one end of the link being pivotally connected to the mounting plate 31 by a pivot pin 73 and the other end of the link 72 pivotally connected to the support bracket 27 by a pivot pin 73A. The free end of the piston rod 74 is fixed to the panel 20C of the door 20 by a suitable fastener 75.

Figure 9:
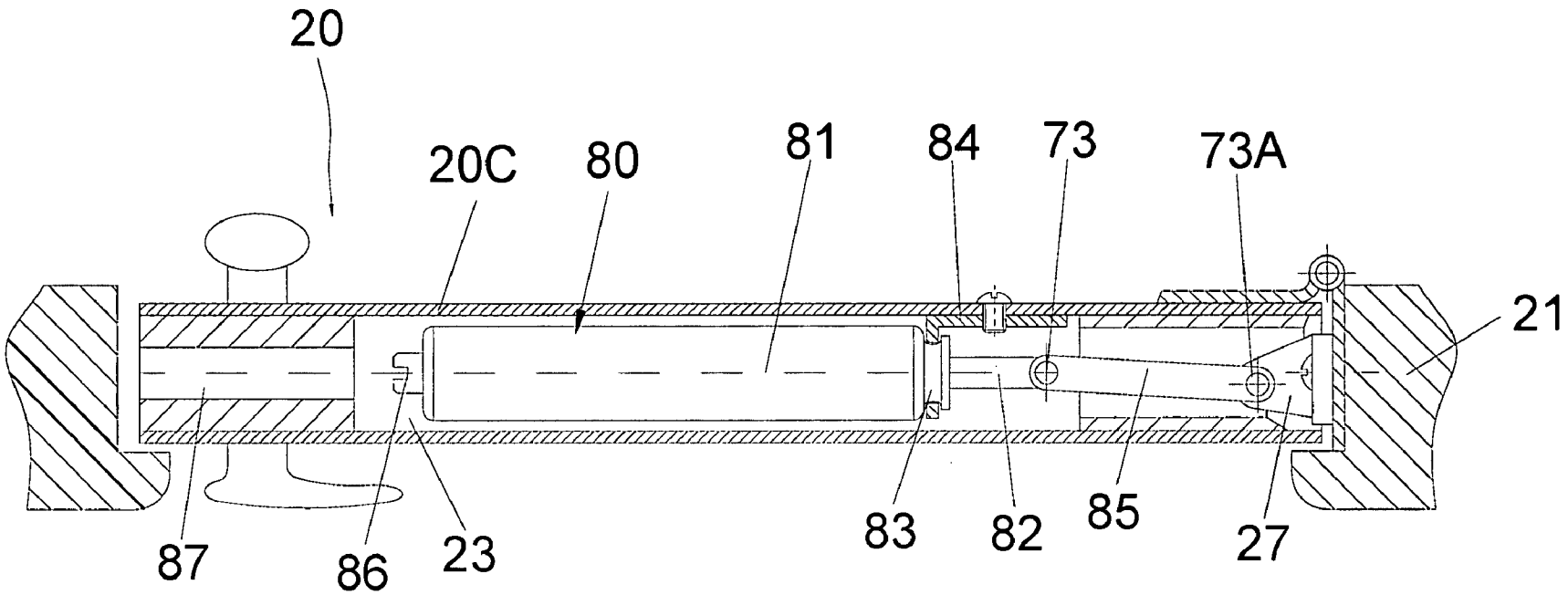
FIG. 9 is a sectional view similar to that of FIG. 2 illustrating a further modified embodiment of the door closer assembly.

FIG. 9 is directed to a further embodiment of the invention. In this embodiment, the linear assembly 80 is supported within the chamber 23 of the door 20 so that the cylinder 81 can be rotated relative to piston rod 82 for effecting any adjustment in the rate of closing of the door, and whereby the linear assembly is restrained against any relative movement along its center line. As shown in FIG. 9, one end of the cylinder 81 is provided with a grooved collar 83 which is journalled to a support bracket 84 secured to the door panel 20C. The front end of the piston rod 82 is attached to the support bracket 27 by means of an interconnected link 85 similar to that described with respect to FIG. 8. The respective ends of the link 85 are pivotally connected to the associated piston rod by pin 73 and to the support bracket 27 by pivot pin 73A. The other end of the cylinder 81 is provided with a slotted boss 86 disposed in alignment with the opening 87 through which a tool, e.g. a screwdriver, can be inserted to effect the speed adjustment of the linear assembly 80.

Figure 10:
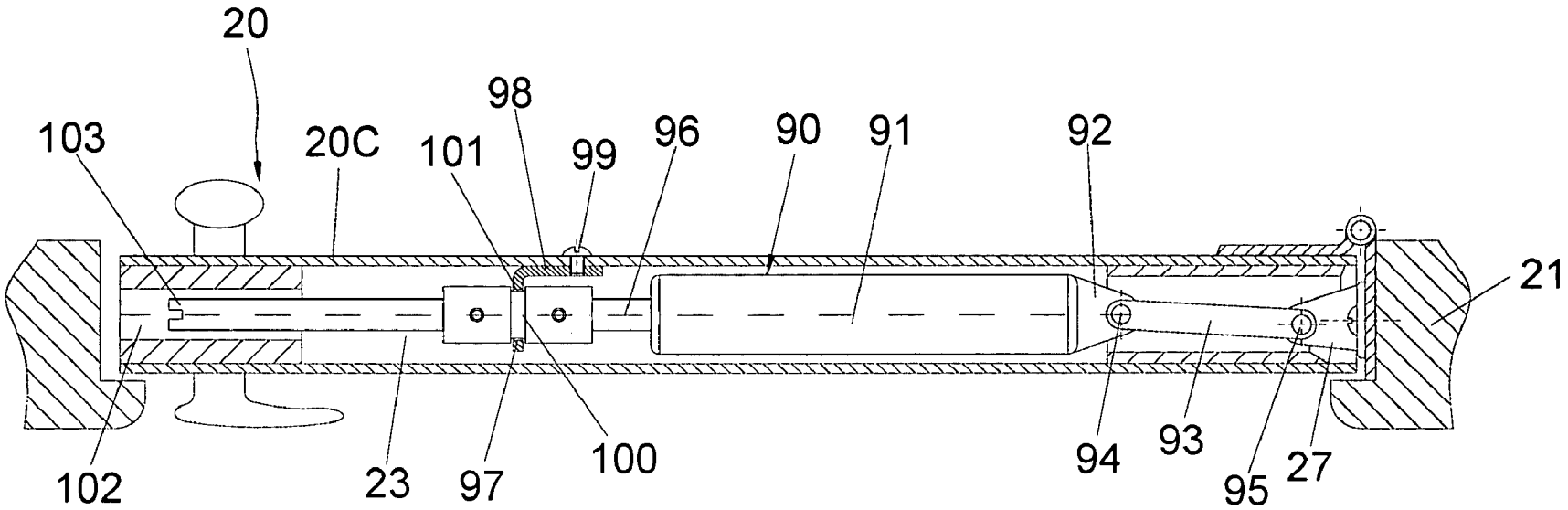
FIG. 10 is a sectional view similar to that of FIG. 2 illustrating a further modified embodiment of a door closer assembly.

FIG. 10 is directed to still a further modification of the invention. In this form of the invention, the cylinder 91 of the linear assembly 90 is slidably mounted within the chamber 23 of the door 20. In this form of the invention, the mounting plate 92 of the cylinder 91 is attached to the support bracket 27 by means of an interconnecting link 93. As shown, the link 93 is pivotally connected at one end to the mounting plate 92 by a pivot pin 94 and the other end of the link 93 is pivotally connected to the support bracket 27 by pivot pin 95.

The piston rod 96 is supported within the chamber 23 in a manner whereby the piston rod is longitudinally fixed, but rendered rotatable about its center line. This is attained by means of a bearing 97 connected to the piston rod 96 at an intermediate point as shown in FIG. 10. The bearing 97 in turn is rotatably supported by a bracket 98 which is suitably secured to the door panel 20C by a fastener 99. In the illustrated embodiment, the bearing 97 is provided with an external annular groove 100 which compliments a mounting hole 101 formed in bracket 98. The arrangement is such that the piston rod 96 is prohibited from encountering any linear movement, but free to rotate about its centerline for adjusting the closing speed of the door as hereinbefore stated. To facilitate the adjusting of the closing speed, the edge of the door opposite the hinged edge is provided with an access opening 102 which is disposed in alignment with the free end of the piston rod 96. As hereinbefore described, the free end of the piston rod 96 is provided with a slot 103 adapted to receive a tool, e.g. a screwdriver, to effect the rotation of the piston rod 96 in one direction or the other to regulate the flow of actuating medium to control the door closing speed as hereinbefore described.

From the foregoing, it will be noted that the variously described embodiments of the linear assembly enables the same to be wholly concealed within a door chamber or cavity so as to substantially enhance the aesthetic appearance of the door assembly, and the arrangement being such that the described linear assembly can perform all of the usual functions of a conventional door closer, while being wholly concealed within a relatively small door cavity or chamber 23.

While the present invention has been described with respect to various embodiments, it will be understood that variations and modifications thereof may be made without departing from the spirit and scope of this invention.

What is claimed is:

1. A door assembly comprising:

a door frame, a door having a predetermined thickness;

said door having one edge thereof adapted for being hingedly connected to said door frame for swinging between and open and closed position;

means defining a horizontally disposed chamber formed within said thickness of said door;

said chamber being disposed in communication with an opening formed in said one edge of said door;

a support bracket adapted for connection to a door frame disposed in alignment with said opening formed in said one edge of said door;

a door closer disposed in said chamber;

a piston displaceably mounted within a cylinder;

a piston rod connected to said piston;

said piston rod having a free end extending through one end of said cylinder;

a spring means interposed between said piston and said one end of said cylinder;

means for mounting said door closer within said chamber to said door and said support bracket, whereby said cylinder and said piston with said connected piston rod is rendered rotatable relative to one another.

2. A door assembly as defined in claim 1 wherein said chamber is disposed in communication with another opening formed in an edge of said door opposite said one edge to provide access to said door closer within said chamber.

3. A door assembly as defined in claim 1 wherein said interconnecting link has one end pivotally connected to said cylinder and having the other end pivotally connected to said support bracket.

4. A door assembly as defined in claim 1 and including an interconnecting link connecting one end of said closer to said support bracket.

5. A door assembly as defined in claim 4 wherein said interconnecting link has one end pivotally connected to said free end of said piston rod and the other end of said link pivotally connected to said support bracket.

* * * * *